US005592381A

United States Patent [19]

Henneuse et al.

[11] Patent Number: 5,592,381

[45] Date of Patent: Jan. 7, 1997

[54] DEVICE FOR PROCESSING AND INTERPRETING DRILLING DATA, PLACED AT THE BOTTOM OF A WELL AND METHOD IMPLEMENTING THIS DEVICE

[75] Inventors: Henry Henneuse, Billere; Elyes Draoui, Pau, both of France

[73] Assignee: Elf Aquitaine Production, Paris, France

[21] Appl. No.: 543,696

[22] Filed: Oct. 16, 1995

Related U.S. Application Data

[63] Continuation of Ser. No. 50,447, Jun. 25, 1993, abandoned.

[51] Int. Cl.[6] ..... G06F 19/00

[52] U.S. Cl. ..... 364/422; 340/853.2

[58] Field of Search ..... 364/421, 422; 340/854.4, 855.5, 853.2; 367/76; 73/151.5, 152, 644; 175/108; 181/401, 119

[56] References Cited

U.S. PATENT DOCUMENTS 5,159,577 10/1992 Twist ..... 367/25

*Primary Examiner*—Donald E. McElheny, Jr.
*Attorney, Agent, or Firm*—Bacon & Thomas

[57] ABSTRACT

A device for processing and interpreting drilling data is mounted at the lower end of a drill-pipe string located in a drilling well and provided with a drill bit and, measuring assembly. The device is arranged to transmit data from the bottom to the surface, but transmits only abbreviated messages to the surface after interpreting the measurements made by the measuring assembly. A method for implementing the device while transmitting data from the bottom of a drilling well to the surface in the form of abbreviated messages after interpreting the measurements made by the measuring assembly.

12 Claims, 7 Drawing Sheets

DEVICE FOR PROCESSING AND INTERPRETING DRILLING DATA, PLACED AT THE BOTTOM OF A WELL AND METHOD IMPLEMENTING THIS DEVICE

This application is a continuation of U.S. patent application Ser. No. 08/050,447, filed Jun. 25, 1993, now abandoned.

BACKGROUND OF THE INVENTION

1. Field of the Invention

The present invention relates to a device for processing and interpreting drilling data, which is placed at the bottom of a well and, more particularly, to such a device intended to be used in oil drilling.

The present invention also relates to a method enabling this device to be implemented.

2. Description of Related Art

During the drilling of a well, for example an oil well, it is desirable for the foreman driller to ascertain the behaviour of the assembly and of the tool at the bottom of the well so as to monitor the drilling parameters better. It is preferable to ascertain these conditions in real time, this necessitating means for transmitting data from the bottom of the well to the surface.

Ascertaining the downhole conditions makes it possible to drill more assuredly and to reduce the drilling costs. Moreover, the foreman driller will have the option of reacting quickly to any downhole event, for example, change of rock type, wear of the tool or mechanical instability.

Several means for transmitting data from the bottom to the surface have been proposed. Among these means is transmission by electrical conductor, or by electromagnetic waves. Data transmission by pressure waves in the drilling mud has also been proposed. In such a system, the pressure of the mud circulating around the drill string is modulated for example by way of a servo valve mounted in a sub-unit placed in the drill string adjacent to the tool.

The pressure waves propagate at around 1500 m/s; they undergo numerous reflections between bottom and surface.

In view of the deterioration in the limitations inherent in modulating the pressure of the mud, and the need to preserve the quality of the data, the data flow rate remains low.

Currently, the data transmission flow rate does not exceed a few bits per second.

In the future, whatever the improvements in the systems for transmitting data in the mud, the speed of transmitting data from the bottom to the surface will remain limited.

In order to alleviate this disadvantage, the data should be preprocessed at the bottom, thus very significantly reducing the volume of the signals to be transmitted to the surface.

Document GB-A-2,216.661 describes a device for measuring the vibrations of a drill string, placed at the bottom of the well, and which includes a processor intended to record the data provided by an accelerometer. The device detects the acceleration levels which exceed a predetermined value and these levels alone are signalled to the surface. Hence, in this device, data which depend on a single parameter are sent to the surface only when a predetermined threshold is crossed, and this without any analysis of physical behaviour having been undertaken.

SUMMARY OF THE INVENTION

The subject of the present invention is a device for processing drilling data, placed at the bottom of a well and which is capable of compiling, at the bottom, various diagnostics specific to the global or individual behaviours of the drilling tool, the drill string, the drilling mud, and/or the well itself, and of signalling these diagnostics to the surface via one of the customary means for transmitting data.

To do this, the invention provides a device for processing and interpreting drilling data, intended to be mounted at the lower end of a drill string placed in a drilling well, the drill string being equipped with a drilling tool, with a measuring unit and with means for transmitting data from the bottom to the surface, characterised in that the device is adapted to send to the surface only abridged messages after interpreting the measurements acquired by the measuring unit.

The subject of the present invention is also a method enabling the aforesaid processing device to be implemented.

The said method includes the following steps:

acquiring measurements dependent on the behaviour of the drilling tool, and generating signals representing these measurements, preprocessing the signals, applying malfunction algorithms to the signals, applying observers to the signals, and sending to the surface abridged messages indicative of the measurements acquired at the bottom.

The method according to the invention makes it possible to optimize the processing of the data and to extract indications which, once transmitted to the surface, enable the drilling conditions to be improved.

Other characteristics and advantages of the present invention will emerge more clearly on reading the description below, given as reference to the attached drawings.

DETAILED DESCRIPTION OF THE PREFERRED EMBODIMENTS

Figure 1:
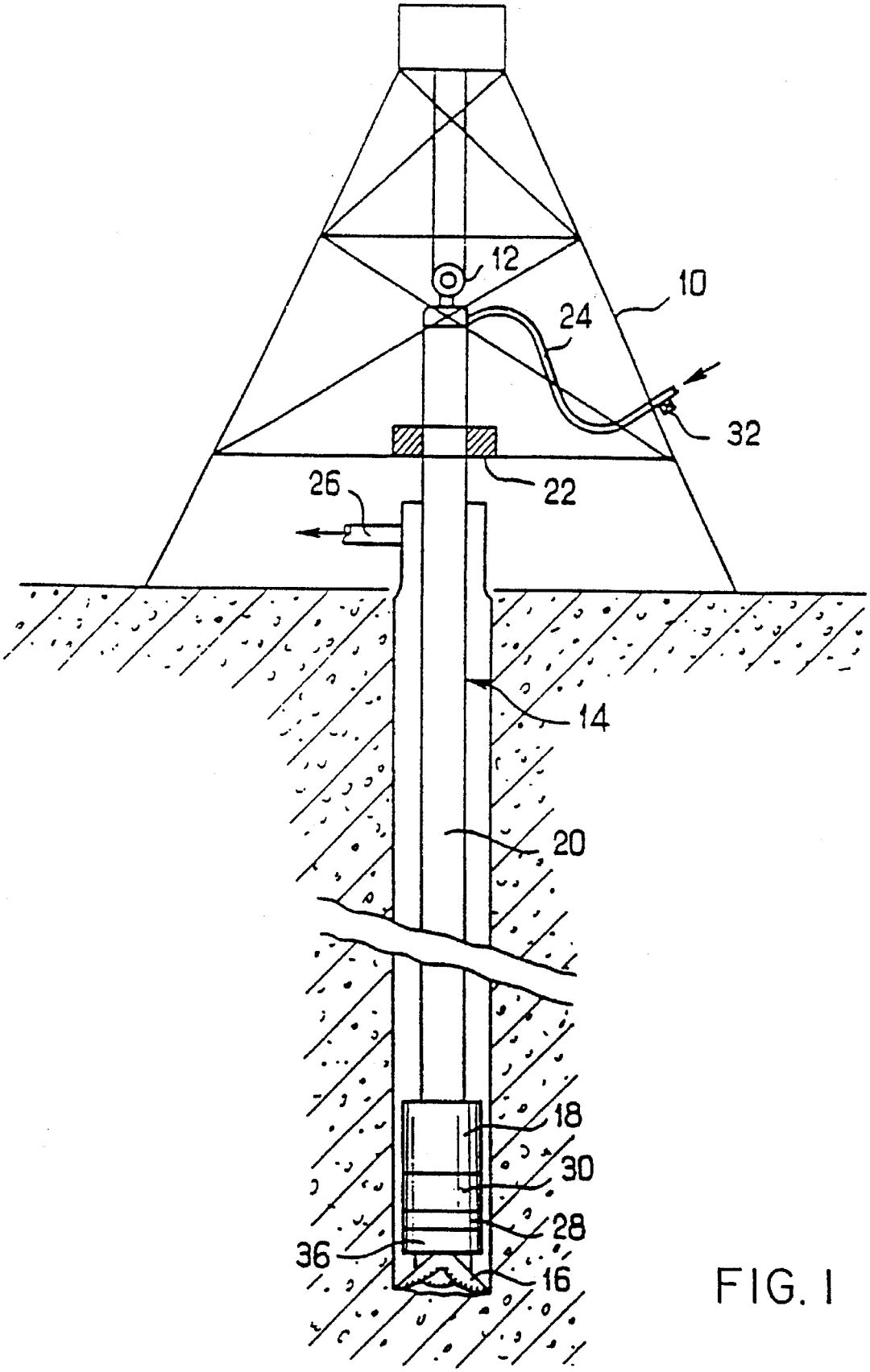
FIG. 1 is a diagrammatic sectional view of a drilling unit.

In FIG. 1 is represented a drilling unit comprising a mast 10 equipped, in a manner known per se, with a hook 12 from which is suspended a drill string represented generally by 14. The drill string 14 comprises a drilling tool 16, drill collars 18 and drill pipes 20. In the example illustrated, the drill string 14 is rotated by a rotary table 22 or by a motorized swivel. A duct 24 introduces pressurized drilling mud into the pipes 20. This mud leaves the tool and circulates in the space between the wall of the well and the drill string 14. It is recovered at the site of a duct 26, recycled and then directed to storage tanks (not shown).

According to the invention, a device 28 for processing and interpreting drilling data is placed inside the assembly, as close as desired to the tool, between the drill collars 18 and the tool 16. As will be described in further detail later, the device comprises a processing and interpreting circuit 30 and means for transmitting data to the surface. The means for transmitting data may comprise an electrical cable, a system of cabled pipes, an electromagnetic transmitter or, in the example illustrated, a system of transmission by pulses generated in the mud.

In this means of transmission, a servo valve mounted in a sub-unit 30 placed adjacent to the tool 16 is intended to modulate the flow of the pressurized mud selectively so as to create pressure waves in the mud. Devices for measuring and monitoring are placed in the sub-unit 30 making it possible, in a known manner, to generate pressure waves in the mud which are representative of the messages transmitted from the bottom. These pressure waves are detected at the surface by a pressure sensor 32, mounted on the duct 24.

The device 28 for processing and interpreting drilling data, as well as the method enabling it to be implemented make it possible to process the various measurements acquired at the bottom and to send various diagnostics to the surface, for example diagnostics regarding malfunctioning of the drilling unit (precession, bouncing of the tool, torsional waves or jamming) and regarding the condition of the tool (wear of the teeth and bearings of the three-cone bits, wear to the cutting tools).

In addition to these diagnostics the method of processing according to the invention makes it possible to quantize the various dynamic measurements making it possible to scale the severity of the vibrations, and thus making it possible to assess the effectiveness of the actions undertaken at the surface by the foreman driller.

Figure 2:
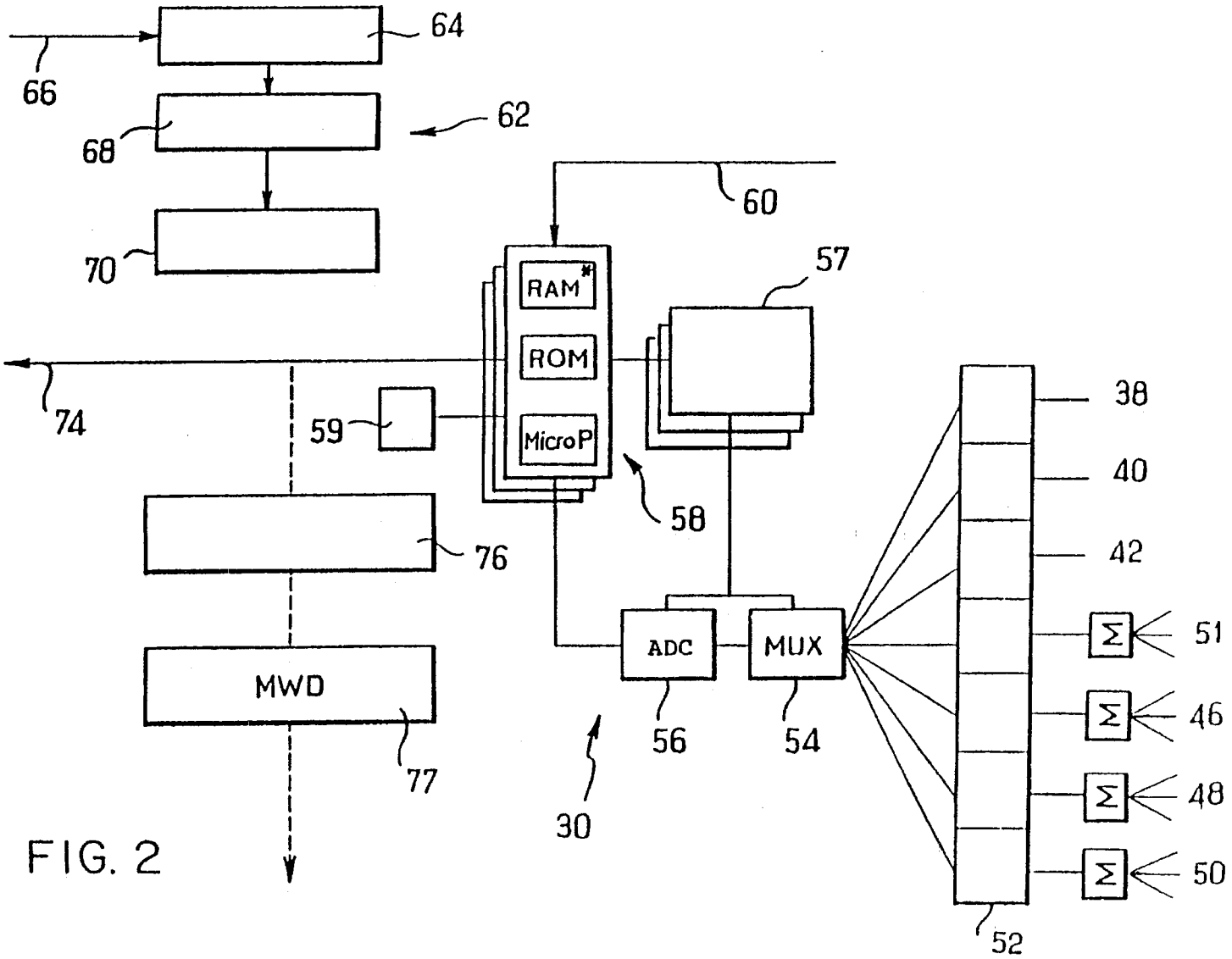
FIG. 2 represents diagrammatically a processing and interpreting circuit, according to the invention.

As is represented in FIG. 2, the processing and interpreting circuit 30 receives data acquired by various measuring devices which are placed in a measuring unit 36 (see FIG. 1) situated next to the tool 16. Data coming from various strain gauges for tension 38, torsion 40 or bending 42, from various magnetometers 46, from axial 48, radial 50 and transverse 51 accelerometers meet up in a multiplexer 54, via anti-aliasing filters 52.

After analog/digital conversion 56, the signals are processed by as many processors 58 and signal processors 57 as necessary. An auxiliary input 60 makes it possible to fully parameterize the device at the surface (or at the bottom in the case of two-way transmission). The circuit processing and interpreting 34 is powered by a sub-unit 62 which includes an alternator 64 driven by the drilling mud at the site of an input 66, an electrical regulating circuit 68 and accumulators 70. A control bus 74 supervises, among other things, the transmission system 76 connected to a modulating servovalve 72.

A non-volatile memory 59 is intended to store information temporarily; this information is retained for interpretation on returning the tool to the surface.

Other measuring devices may be used to allow determination of the following parameters: weight on the tool, torque, internal and external pressures, internal and external temperatures and mud flow rate.

With the bottom measurements from the measuring unit 36, the processing circuit 34 makes it possible to signal to the surface various conditions, malfunctions or faults or severity of vibration of the drilling unit.

Figure 3:
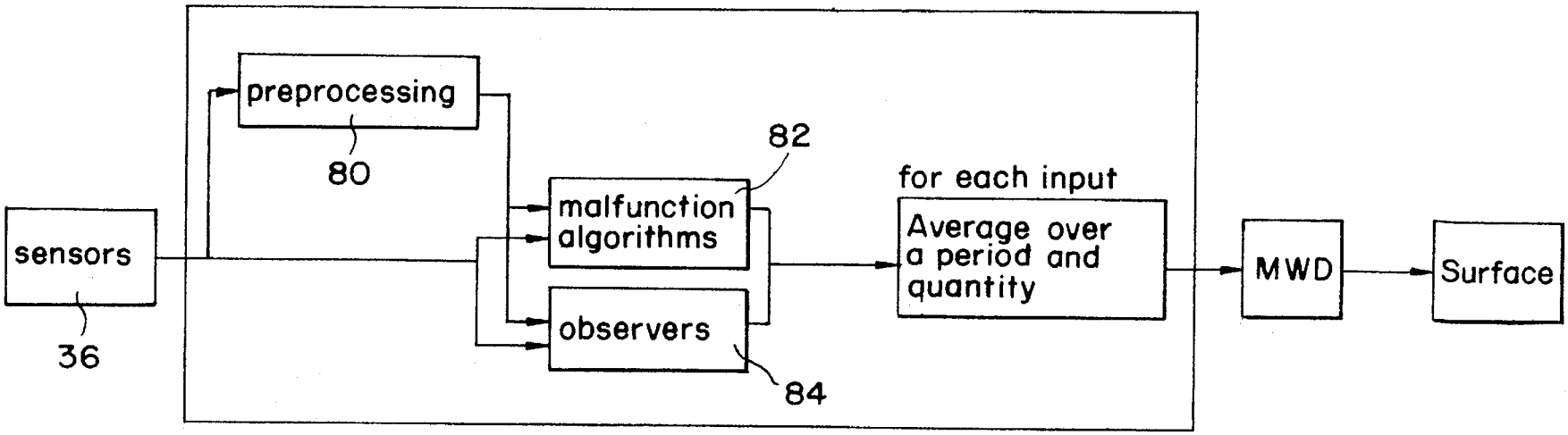
FIGS. 3 to 7 are, in each case, charts enabling the method according to the invention to be implemented.

A method implementing the device of the present invention is represented diagrammatically in FIG. 3.

Figure 4:
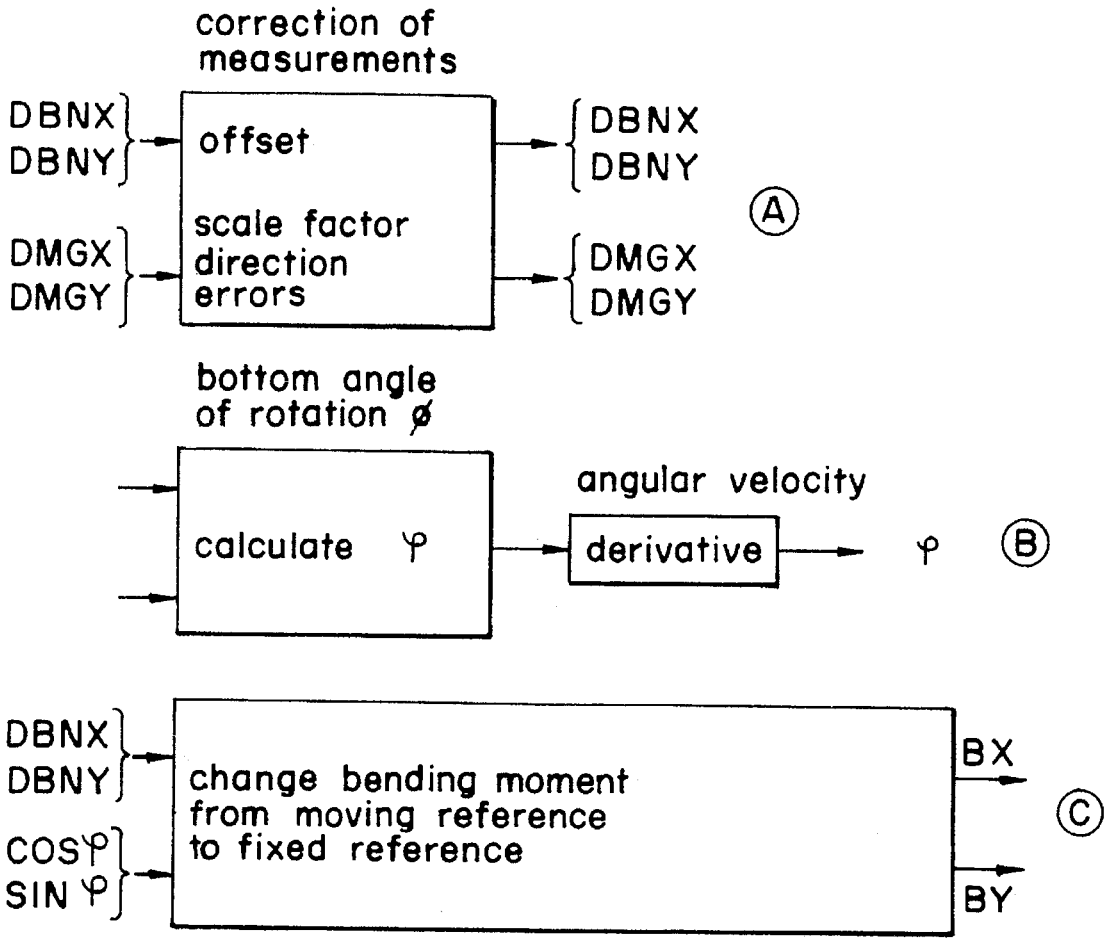

The signals from the various strain gauges 38 to 51 making up the measuring unit 36 are preprocessed, where appropriate, at 80 so as to remove the offsets, physically rescale the measurements and reposition them within a fixed reference. This preprocessing is represented in further detail-in FIG. 4. The meaning of the initials representing the signals is given below: DBNX: Bending moment at the bottom, about the X axis DBNY: Bending moment at the bottom, about the Y axis DMGX: Magnetometric measurements along the X axis DMGY: Magnetometric measurements along the Y axis DWOB: Weight on the tool DACZ: Acceleration along the Z axis DTOB: Torque on the tool This preprocessing step makes it possible to check whether the set of measurements is correct and also enables the speed of rotation of the tool to be calculated from magnetometric measurements DMGX and DMGY. Since the measurements are made in a moving reference, they should be repositioned within the fixed reference.

Next, as represented in FIG. 3, the signals arising directly from the sensors 36, as well as the preprocessed signals, go through malfunction algorithms 82 and observers 84.

Figure 5:
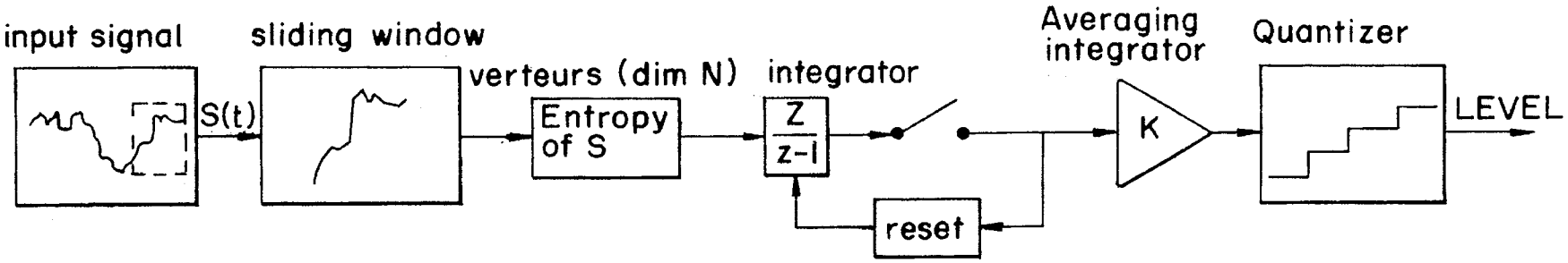
Figure 6:
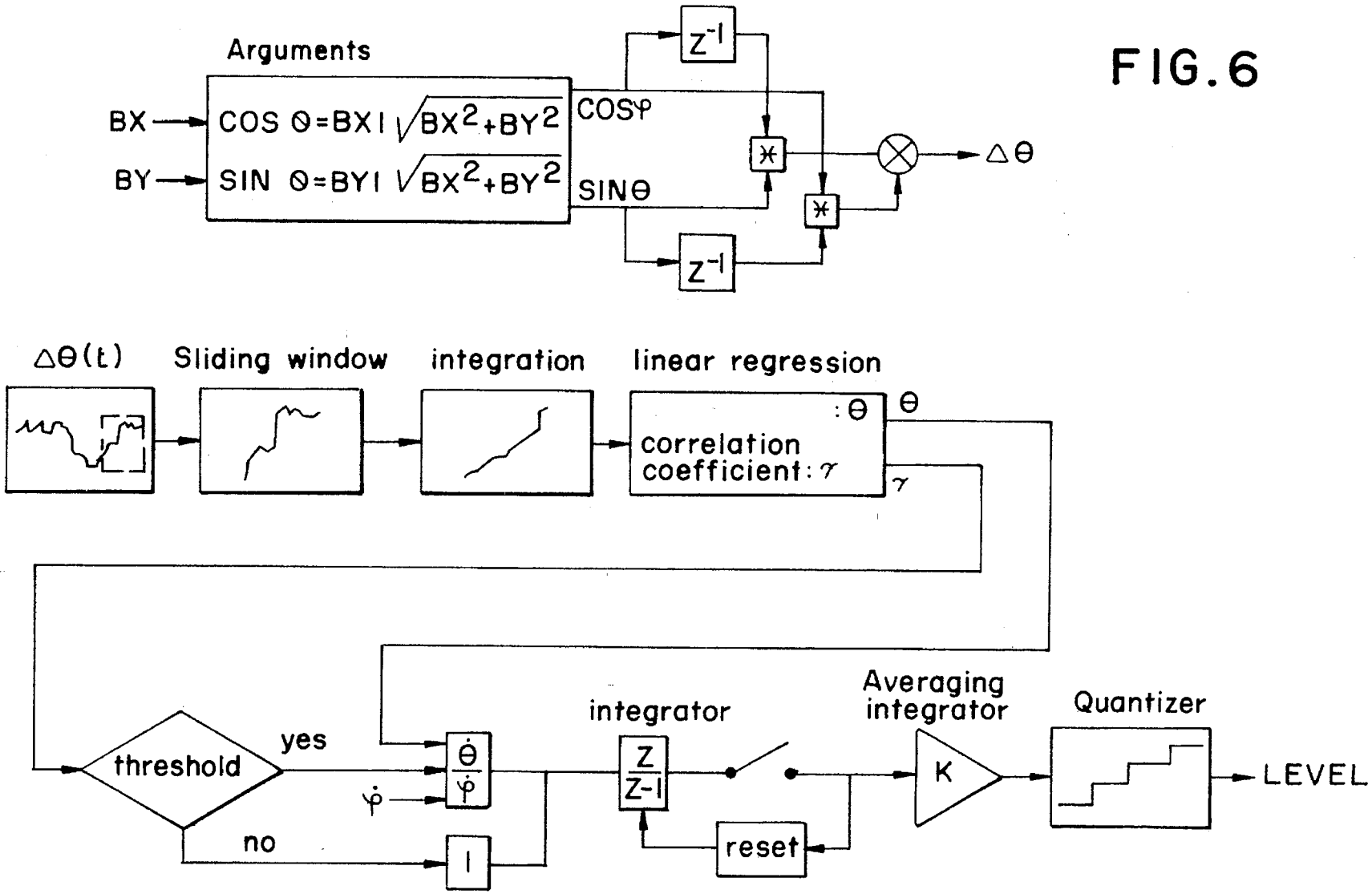

The malfunction algorithms 82 are represented in further detail in FIGS. 5 and 6. These algorithms enable the entropy of the various dynamic measurements (DWOB; DTOB; DBNX; DBNY) to be quantized.

From these measurements, it is possible to detect the following conditions of the drilling assembly:

level of rebound of the tool, presence and characterization of rotational instabilities, presence and characterization of chaotic lateral vibrations, wear of the tool (bearings, teeth, etc.), nozzle loss in the tool, leaks in the region of the downhole motor, sub-shock function rating, jamming at the tool, jamming or sticking at the stabilizers.

The step of the method represented in FIG. 6 makes it possible to detect all types of precession and to quantize them as a function of their direction.

Figure 7:
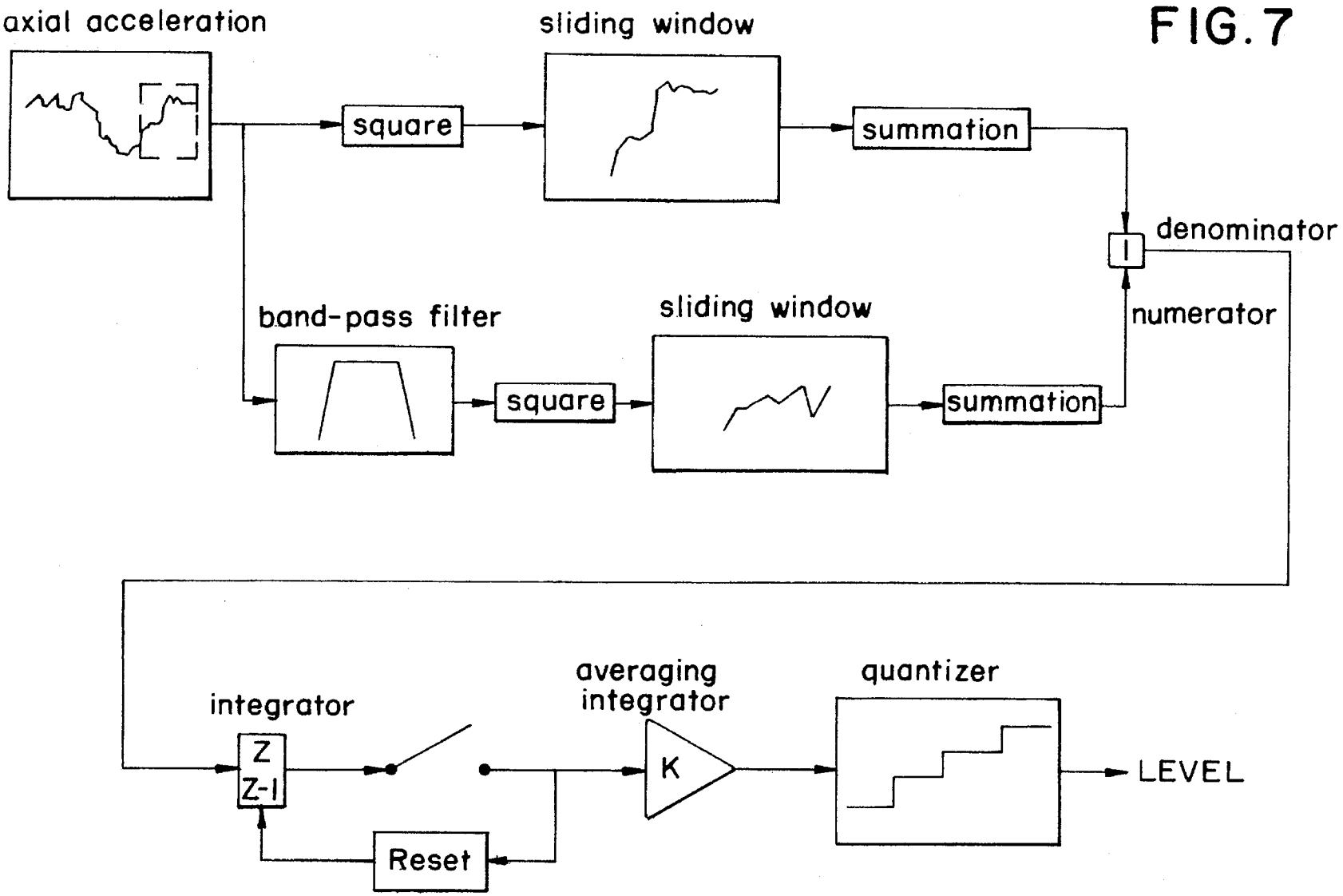

In FIG. 7 is represented the final step of the processing of the data, that of the observers 84. This step enables the energy consumed by the tool per unit destroyed rock to be determined. With these data, it is possible to prepare an energy budget for the tool which constitutes, for the driller, a good indicator of the operation of the tool and of its advance.

With the development in the degree of understanding of downhole mechanical phenomena, the device will take into account new diagnostic capabilities.

The pressure sensor 32, intended to detect the pulses generated in the mud, is connected to a frame decoder and to an interpretation station (which are not shown) advantageously embodied by an office computer.

Thus, according to the invention, the processing circuit 30, instead of sending voluminous data to the surface, dependent on each of the measurements acquired at the bottom, sends to the surface only signals which indicate the condition of operation of the drilling unit. Quite obviously, the flow rate required for these transmissions remains compatible with the state of the art.

Even after compiling abridged messages, the flow rate may turn out to be still too low. The processing and interpreting device is capable of prioritizing the sending of these messages.

In order to ensure a wider field of investigation, the device for processing and interpreting drilling data of the invention can be used in combination with a device for dynamic measurements of a drill string, such as described in the document EP-A-0,431,136, or in French Patent Applications 90 09638 or 90 12978.

We claim:

1. In a device for processing and interpreting drilling data, including a drill string and, mounted at a lower end of the drill string, a drilling tool, a measuring unit, and means for transmitting data from a bottom of a drilling well to a surface, the improvement wherein said means for transmitting data from the bottom to the surface comprises means for interpreting the measurements acquired by the measuring unit and means for sending to the surface abridged messages based on the interpreted measurements.

2. A method of processing and interpreting drilling data of a drilling tool comprising the steps of:

a) acquiring measurements from the drilling tool, and generating signals representing these measurements;

b) preprocessing the signals;

c) processing the signals to diagnose a condition of operation of the drilling tool;

generating diagnostics concerning the condition of operation of the drilling tool; and e) subsequently sending to the surface abridged messages indicative of the measurements acquired at the bottom.

3. In a device for processing and interpreting drilling data, including a drill string and, mounted at a lower end of the drill string, a drilling tool, a measuring unit, and means for transmitting data from a bottom of a drilling well to a surface, the improvement wherein said means for transmitting data from the bottom to the surface comprises means including an processing circuit for interpreting the measurements acquired by the measuring unit and means for sending to the surface abridged messages based on the interpreted measurements, wherein said means for interpreting the measurements includes means for interpreting data representing two drilling parameters by combining the data to obtain a third drilling parameter and generating diagnostics regarding a condition of operation of the drilling unit before transmitting the data to the surface, whereby instead of sending voluminous data to the surface, dependent on each of any measurements acquired at the bottom, only signals which indicate the condition of operation of the drilling unit are sent to the surface.

4. A device according to claim 3, wherein said first and second parameters are position data obtained by magnetometric measurements and said third parameter is an angular velocity.

5. A device according to claim 3, wherein said first and second parameters are coordinates in a moving reference frame and an angular position of the frame, and said third parameter is a coordinate in a fixed reference frame.

6. A method according to claim 2, wherein said step of preprocessing the signals includes the steps of correcting the signals and converting the corrected signals from a moving reference to a fixed reference.

7. A device according to claim 3, wherein said means for generating diagnostic concerning a condition of operation of the drilling unit includes means for generating diagnostics concerning malfunctioning of the drilling unit selected from the group consisting of precession, bouncing of the tool, torsional waves, and jamming.

8. A device according to claim 3, wherein said means for generating diagnostics concerning a condition of operation of the drilling unit comprises means for generating diagnostics concerning a condition of the tool selected from the group consisting of wear of the teeth and bearing of a bit, and wear to cutting tools.

9. A device according to claim 3, wherein said processing circuit further comprises means for observing energy consumption of the tool.

10. A method according to claim 2, wherein the step of diagnosing a condition of operation of the of the drilling tool comprises the step of processing said signals to diagnose malfunctioning of the drilling unit and is selected from the group consisting of precession, bouncing of the tool, torsional waves, and jamming.

11. A method according to claim 2, wherein the step of diagnosing a condition of operation of the drilling tool comprises the step of processing said signals to diagnose malfunctioning of the drilling unit and is selected from the group consisting of precession, bouncing of the tool, torsional waves, and jamming.

12. A method according to claim 2, further comprising the step of observing energy consumption based on the signals.

* * * * *